US005995799A

United States Patent [19]

Nagashima et al.

[11] Patent Number: 5,995,799

[45] Date of Patent: Nov. 30, 1999

[54] IMAGE FORMING MACHINE TONER REPLENISHING DEVICE CAPABLE OF AGITATING THE TONER TO AVOID TONER STAGNATION

[75] Inventors: Takashi Nagashima; Ryoji Nishimura; Ikuo Makie; Satoru Yonemoto; Toshinori Nishimura, all of Osaka, Japan

[73] Assignee: Mita Industrial Co., Ltd., Osaka, Japan

[21] Appl. No.: 09/006,482

[22] Filed: Jan. 13, 1998

[30] Foreign Application Priority Data

Jan. 14, 1997 [JP] Japan ..... 9-004538

[51] Int. Cl.[6] ..... G03G 21/10

[52] U.S. Cl. ..... 399/359

[58] Field of Search ..... 399/359, 358, 399/120, 254, 255, 256

[56] References Cited

U.S. PATENT DOCUMENTS 5,508,792 4/1996 Ishida et al. ..... 399/256

5,617,195 4/1997 Torimaru et al. ..... 399/358 X 5,742,882 4/1998 Lee ..... 399/359 X

*Primary Examiner*—Susan S. Y. Lee

*Attorney, Agent, or Firm*—Antonelli, Terry, Stout & Kraus, LLP

[57] ABSTRACT

A toner replenishing device for an image forming machine has a hopper housing with a toner agitating passageway and a toner carrying passageway, a toner agitator disposed in the toner agitating passageway for agitating recovered toner and fresh toner supplied to the toner agitating passageway and lifting them to the toner carrying passageway, and a toner carrier disposed in the toner carrying passageway for carrying the recovered toner and the fresh toner agitated and lifted by the toner agitator. The toner agitator has a first paddle disposed in a first end part of the toner agitating passageway, and a second paddle disposed on the other end part side of the toner agitating passageway and adjacent to the first paddle. The first paddle has the function of sending the toner to the other end part side of the toner agitating passageway, while the second paddle has the function of sending the toner to the first end part side of the toner agitating passageway.

6 Claims, 5 Drawing Sheets

IMAGE FORMING MACHINE TONER REPLENISHING DEVICE CAPABLE OF AGITATING THE TONER TO AVOID TONER STAGNATION

FIELD OF THE INVENTION

This invention relates to a toner replenishing device which is mounted in an image forming machine, such as an electrostatic copier or an electrostatic printer.

DESCRIPTION OF THE PRIOR ART

This type of image forming machine comprises a rotatably disposed photoconductor drum, a developing device for developing an electrostatic latent image formed on the peripheral surface of the photoconductor drum to a toner image by applying toner to the electrostatic latent image, cleaning device for removing the remaining toner adhering to the peripheral surface of the photoconductor drum, and a toner replenishing device for supplying fresh toner to the developing device. An image forming machine of the type which recovers the remaining toner removed by the cleaning device and uses it again finds practical use widely. In the image forming machine recycling the recovered toner, the recovered toner is carried to the toner replenishing device, mixed with fresh toner, and supplied to the developing device.

The toner replenishing device of the above-described type comprises a hopper housing having a toner agitating passageway, a toner carrying passageway formed parallel to the toner agitating passageway and at a position higher than the toner agitating passageway, a recovered toner inlet formed adjacent a first end part of the toner agitating passageway for having recovered toner sent in therethrough, and a fresh toner supply port formed above the other end part of the toner agitating passageway and opposite the toner agitating passageway; toner agitating means disposed in the toner agitating passageway for agitating the recovered toner and the fresh toner supplied to the toner agitating passageway and lifting them to the toner carrying passageway; toner carrying means disposed in the toner carrying passageway for carrying the toner mixture of recovered toner and fresh toner that has been agitated and lifted by the toner agitating means; and toner supplying means for conveying the toner mixture carried by the toner carrying means to the developing device.

The toner agitating means is composed of one paddle. The fresh toner supplied through the fresh toner supply port to the toner agitating passageway, and the recovered toner sent in through the recovered toner inlet have only the toner around the front end of the paddle agitated and lifted by the rotation of the paddle to the toner carrying passageway. In contrast the toner near the center of the paddle tends to remain stagnant. This stagnating toner deteriorates due to changes with time, and declines in charge performance. The toner that has deteriorated owing to changes with time is also to be sent to the toner carrying passageway and carried to the developing device. Because of lowered charge performance, this toner debases the quality of the resulting image.

Some ten percent of the toner mixture of fresh toner and recovered toner sent by the paddle constituting the agitating means to the toner carrying passageway drops to the toner agitating passageway while being carried by the toner carrying means. If the toner mixture falls to the toner agitating passageway, the proportion of recovered toner in the toner agitating passageway gradually increases. If toner with an increased proportion of the recovered toner is fed to developing device, this will cause a lowered image quality.

SUMMARY OF THE INVENTION

A first object of the present invention is to provide a toner replenishing device for an image forming machine which can avoid or at least delay the deterioration of toner owing to its stagnation, by making fresh toner and recovered toner supplied to the toner agitating passageway flow without causing them to stagnate near the center of the toner agitating means.

A second object of the present invention is to provide a toner replenishing device for an image forming machine which can prevent a toner mixture of fresh toner and recovered toner that has been sent to the toner carrying passageway from falling to the toner agitating passageway, thereby preventing an increase in the proportion of recovered toner in the toner agitating passageway.

To attain the first object, the invention provides a toner replenishing device for an image forming machine, which comprises a hopper housing having a toner agitating passageway, a toner carrying passageway formed parallel to the toner agitating passageway and at a position higher than the toner agitating passageway, a recovered toner inlet formed in a first end part of the toner agitating passageway for having recovered toner sent in therethrough after being carried from a cleaning device of the image forming machine, and a fresh toner supply port formed above the other end part of the toner agitating passageway and opposite the toner agitating passageway;

toner agitating means disposed in the toner agitating passageway for agitating the recovered toner and fresh toner supplied to the toner agitating passageway and lifting them to the toner carrying passageway;

toner carrying means disposed in the toner carrying passageway for carrying the recovered toner and the fresh toner agitated and lifted by the toner agitating means; and a toner supplying mechanism for conveying the recovered toner and the fresh toner carried by the toner carrying means to a developing device of the image forming machine; wherein the toner agitating means has a first paddle disposed in the first end part of the toner agitating passageway and a second paddle disposed on the other end part side of the toner agitating passageway and adjacent to the first paddle, and the first paddle has the function of sending the toner to the other end part side of the toner agitating passageway, while the second paddle has the function of sending the toner to the first end part side of the toner agitating passageway.

To attain the second object, the invention provides a toner replenishing device for an image forming machine, which comprises a hopper housing having a toner agitating passageway, a toner carrying passageway formed parallel to the toner agitating passageway and at a position higher than the toner agitating passageway, a recovered toner inlet formed in one end part of the toner agitating passageway for having recovered toner sent in therethrough after being carried from a cleaning device of the image forming machine, and a fresh toner supply port formed above the other end part of the toner agitating passageway and opposite the toner agitating passageway;

toner agitating means disposed in the toner agitating passageway for agitating the recovered toner and fresh toner supplied to the toner agitating passageway and lifting them to the toner carrying passageway;

toner carrying means disposed in the toner carrying passageway for carrying the recovered toner and the fresh toner agitated and lifted by the toner agitating means; and a toner supplying mechanism for conveying recovered toner and the fresh toner carried by the toner carrying means to a developing device of the image forming machine; wherein a partition plate is disposed between the toner agitating passageway and the toner carrying passageway with the one end part of the toner agitating passageway lacking the partition plate.

Other characteristics of the invention will become clear from the following description.

DETAILED DESCRIPTION OF THE PREFERRED EMBODIMENTS

The present invention will now be described in detail with reference to the accompanying drawings illustrating preferred embodiments of a toner replenishing device for an image forming machine constructed in accordance with the present invention.

Figure 1:
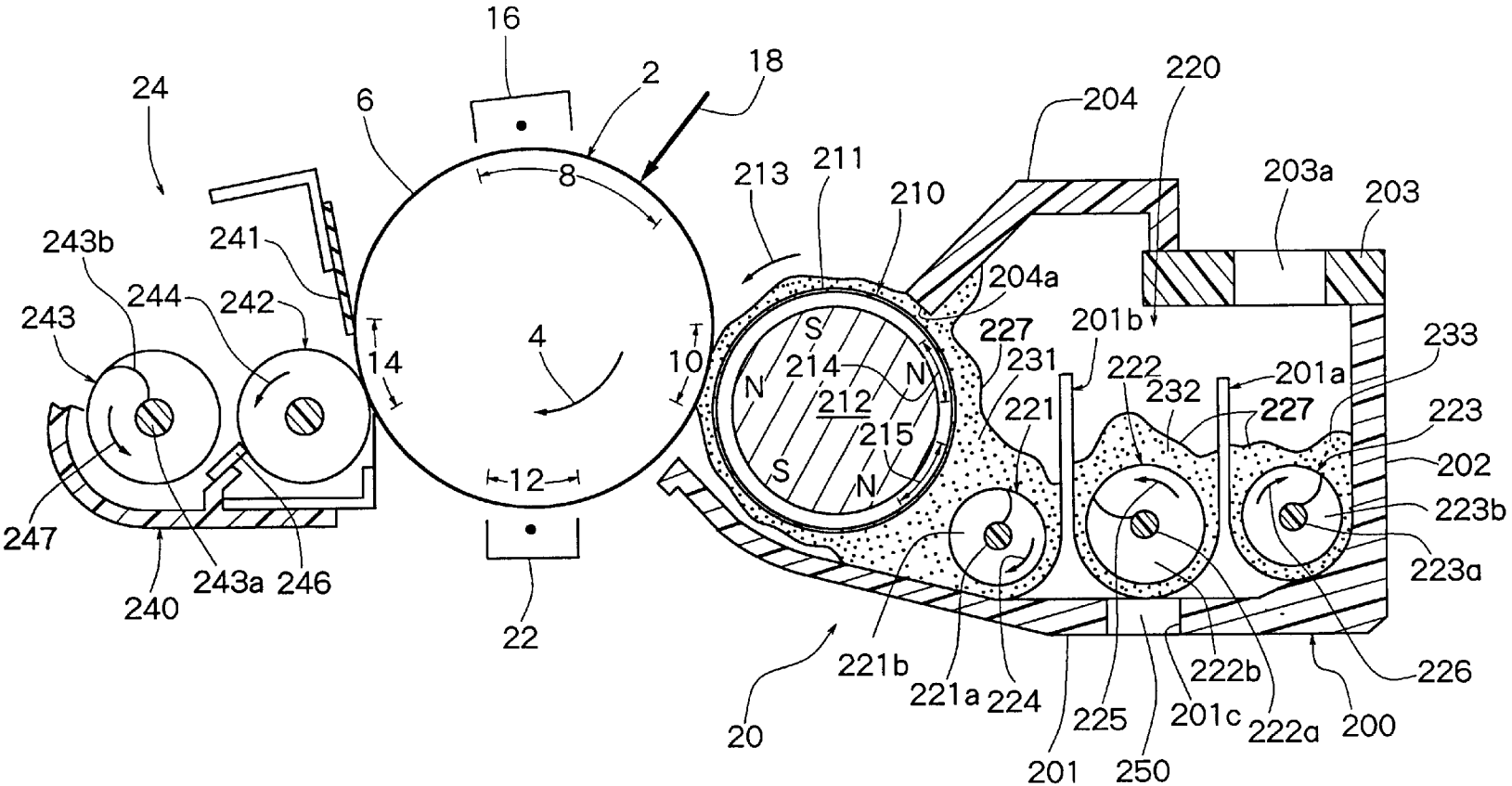
FIG. 1 is a sectional view showing an embodiment of an image forming machine equipped with a toner replenishing device constructed in accordance with the present invention.

FIG. 1 shows an image forming machine equipped with a toner replenishing device constructed in accordance with the present invention. With reference to FIG. 1, the image forming machine has a rotating drum 2 adopted to be rotated in the direction shown by an arrow 4. On the peripheral surface of the rotating drum 2, an electrostatic photoconductor 6 constituting image bearing means is formed. When the rotating drum 2 is rotated in the direction of the arrow 4, the electrostatic photoconductor 6 is sequentially passed through an electrostatic latent image forming area 8, a developing area 10, a transfer area 12 and a cleaning area 14. In the electrostatic latent image forming area 8, the surface of the electrostatic photoconductor 6 is charged uniformly to a specific polarity by the action of a corona discharger 16. Then, the electrostatic photoconductor 6 charged uniformly to the specific polarity is exposed by exposing means, as schematically shown by an arrow 18, to have an electrostatic latent image formed thereon. In the developing area 10, toner is applied to the electrostatic latent image on the electrostatic photoconductor 6 by an electrostatic latent image developing device; shown entirely by a numeral 20, to develop the electrostatic latent image to a toner image. In the transfer area 12, the toner image on the electrostatic photoconductor 6 is transferred to a sheet member (not shown) carried through the transfer area 12. At this time, a transfer discharge current is applied to the back of the sheet member, such as plain paper, by a corona discharger 22. In the cleaning area 14, the remaining toner on the electrostatic photoconductor 6 is removed by the action of a cleaning device shown entirely by a numeral 24. The illustrated image forming machine is adapted to recover the toner removed from the surface of the electrostatic photoconductor 6 and recycle the recovered toner to the electrostatic latent image developing device 20.

An explanation of the electrostatic latent image developing device 20 will be offered below. The electrostatic latent image developing device 20 has a development housing 200. The development housing 200, optionally molded from suitable synthetic resin, includes a bottom wall 201, a rear wall 202 extending upwards substantially vertically from the rear side edge of the bottom wall 201, and front and back end walls (not shown). To the rear wall 202, an upper wall 203 protruding substantially horizontally forwards from the upper end of the rear wall 202, is connected. To the upper wall 203, a cover wall 204 is further connected. In the upper wall 203 constituting the development housing 200, a toner acceptance opening 203*a* is provided in nearly the center thereof in the width direction (the direction perpendicular to the sheet face of FIG. 1).

In the foremost part of the development housing 200 (the leftmost part in FIG. 1), developer applicator means 210 is disposed. The developer applicator means 210 is composed of a sleeve member 211 extending widthwise substantially horizontally, and a permanent magnet member 212 disposed in the sleeve member 211. The sleeve member 211 is composed of a nonmagnetic material such as aluminum, and is mounted rotatably, while the permanent magnet member 212 is fixed at a predetermined position. The sleeve member 211 is rotationally driven by a driving mechanism (not shown) in the direction shown by an arrow 213. The free end 204*a* of the cover wall 204 constituting the development housing 200 is positioned in the vicinity of the peripheral surface of the sleeve member 211 of the developer applicator means 210, and as will be described in detail later on, functions as so-called head cutting means for restricting the amount of a developer which is held on the peripheral surface of the sleeve member 211 and carried to the developing area 10.

Behind the developer applicator means 210, a developer agitating/carrying mechanism 220 is disposed. The developer agitating/carrying mechanism 220 in the illustrated embodiment has an upstream partition 201*a* and a downstream partition 201*b* disposed parallel to the developer applicator means 210 and with predetermined spacing from each other in the front-to-back direction in the development housing 200 (the left-to-right direction in FIG. 1). The upstream partition 201*a* and the downstream partition 201*b* have developer transport openings in the central and opposite end parts in the width direction thereof (the direction perpendicular to the sheet face of FIG. 1), although this is not shown. Because of the upstream partition 201*a* and the downstream partition 201*b* constituted in this manner, a first carrying passageway 231 is defined between the downstream partition 201*b* and the developer applicator means 210, a second carrying passageway 232 is defined between the upstream partition 201*a* and the downstream partition 201*b*, and a third carrying passageway 233 is defined between the upstream partition 201*a* and the rear wall 202 of the development housing 200, in the development housing 200.

The illustrated developer agitating/carrying mechanism 220 has a first agitating/carrying member 221 disposed in the first carrying passageway 231, a second agitating/carrying member 222 disposed in the second carrying passageway 232, and a third agitating/carrying member 223 disposed in the third carrying passageway 233. The first agitating/carrying member 221, the second agitating/carrying member 222 and the third agitating/carrying member 223 are disposed in the same plane in the illustrated embodiment.

The first agitating/carrying member 221 comprises a rotating shaft 221*a*, and a spiral blade 221*b* provided on the rotating shaft 221*a* and formed with the winding direction of the spiral being reversed, beginning at the center thereof as the border. The first agitating/carrying member 221 is rotatably mounted on the front and rear end walls of the development housing 200, and is rotationally driven by a driving mechanism (not shown) in the direction indicated by an arrow 224. The second agitating/carrying member 222 comprises a rotating shaft 222*a*, and a spiral blade 222*b* provided on the rotating shaft 222*a* and formed with the winding direction of the spiral being reversed, beginning at the center thereof as the border. The second agitating/carrying member 222 is rotatably mounted on the front and rear end walls of the development housing 200, and is rotationally driven by a driving mechanism (not shown) in the direction indicated by an arrow 225. The third agitating/carrying member 223 comprises a rotating shaft 223*a*, and a spiral blade 223*b* provided on the rotating shaft 223*a* and formed with the winding direction of the spiral being reversed, beginning at the center thereof as the border. The third agitating/carrying member 223 is rotatably mounted on the front and rear end walls of the development housing 200, and is rotationally driven by a driving mechanism (not shown) in the direction indicated by an arrow 226.

As shown in FIG. 1, a developer 227 comprising a toner and carrier particles, is contained in the development housing 200. The developer 223 is contained there in such a manner as to be suitably distributed among the first carrying passageway 231 defined between the downstream partition 201*b* and the developer applicator means 210, the second carrying passageway 232 defined between the upstream partition 201*a* and the downstream partition 201*b*, and the third carrying passageway 233 defined between the upstream partition 201*a* and the rear wall 202 of the development housing 200. The first agitating/carrying member 221 disposed in the first carrying passageway 231 and rotationally driven in the direction of the arrow 224 carries the developer from the central part to the opposite end parts while agitating it. The second agitating/carrying member 222 disposed in the second carrying passageway 232 and rotationally driven in the direction of the arrow 225 carries the developer from the opposite end parts to the central part while agitating it. The third agitating/carrying member 223 disposed in the third carrying passageway 233 and rotationally driven in the direction of the arrow 226 carries the developer from the central part to the opposite end parts while agitating it.

With further reference to FIG. 1, an opening 201*c* is formed in the central part in the width direction of the bottom wall 201 of the development housing 200 that faces the second carrying passageway 232. In the opening 201*c*, a detector 250 is disposed for detecting the toner concentration in the developer 227. The detector 250 may be of a type well known per se which detects the toner concentration in the developer 240 by detecting the permeability of the developer 227 present on the upper surface exposed to the outside in the development housing 200 through the opening 201*c*. The so constituted electrostatic latent image developing device 20 is supplied with toner by a toner replenishing device which is actuated in accordance with the toner concentration in the developer 227 detected by the detector 250. This toner replenishing device will be described in detail later on.

Next, the cleaning device 24 will be described. The cleaning device 24 may be of a type well known per se, and includes a cleaning container 240, a cleaning blade 241, a cleaning roller 242, and recovered toner carrying means 243. The cleaning roller 242 is rotationally driven in the direction of an arrow 244 and is provided with an auxiliary blade 246. The front end of the cleaning blade 241 is pressed against the peripheral surface of the electrostatic photoconductor 6 of the rotating drum 2.

The cleaning roller 242 acts on the peripheral surface of the electrostatic photoconductor 6, rotated in the direction of the arrow 4, and removes toner therefrom. The remaining toner on the electrostatic photoconductor 6 is removed by the action of the cleaning blade 241 and dropped onto the cleaning roller 242. The cleaning roller 242 holds the toner on its peripheral surface, and carries it in the direction indicated by an arrow 244. The toner held on the peripheral surface of the cleaning roller 242 and conveyed in the direction of the arrow 244 is removed from the peripheral surface of the cleaning roller 242 by the auxiliary blade 246, and collected in one side part of the cleaning container 240 (the left side part in FIG. 1). The recovered toner carrying means 243 is composed of a rotating shaft 243*a* extending in the width direction (the direction perpendicular to the sheet face of FIG. 1) in the one side part of the cleaning container 240, and a spiral blade 243*b* provided on the peripheral surface of the rotating shaft 243*a*. The recovered toner carrying means 243 is rotationally driven in the direction of an arrow 247 to convey the recovered toner collected in the one side part of the cleaning container 240 to a toner replenishing device to be described later on.

Next, the actions of the image forming machine constituted in the foregoing manner will be outlined. When the developer agitating/carrying mechanism 220 of the electrostatic latent image developing device 20 is actuated, the developer in the development housing 200 is carried toward the developer applicator means 210 and is subjected to the action of the developer applicator means 210. The sleeve member 211 of the developer applicator means 210 is rotated in the direction of the arrow 213 to scoop up part of the developer 227 in a developer scooping-up area, indicated by a numeral 214, to the peripheral surface of the sleeve member 211 under a magnetic field created by the stationary permanent magnet member 212. The developer 227 scooped up onto the peripheral surface of the sleeve member 211 is carried in the direction of the arrow 213 by the rotation of the sleeve member 211 until it reaches the developing area 10. During this movement, the excess developer 227 is removed from the peripheral surface of the sleeve member 211 by the action of the free end 204*a* of the cover wall 204 of the development housing 200. In the developing area 10, as described previously, the toner in the developer 227 is selectively caused to adhere to the electrostatic latent image formed on the peripheral surface of the electrostatic photoconductor 6 provided on the rotating drum 2, whereby the electrostatic latent image is developed to a toner image. In a developer peeling area 215 positioned downstream of the developing area 10, the developer 227 is released from the peripheral surface of the sleeve member 211, partly because of a decrease in the magnetic field produced by the permanent magnet member 212. Such developer 227 is decreased in the toner concentration because of the consumption of the toner in the developing area 10. The developer 227 released from the peripheral surface of the sleeve member 211 is mixed into the developer 227 in the development housing 200. The toner image formed on the peripheral surface of the rotating drum 2 in the developing area 10 is transferred to a sheet member in the transfer area 12. The toner remaining on the peripheral surface of the rotating drum 2 after this action is removed by the cleaning device 24 in the cleaning area 14. The removed toner is conveyed by the recovered toner carrying means 243 to a toner replenishing device to be described later on.

A toner replenishing device will be described with reference to FIGS. 2 to 6.

Figure 2:
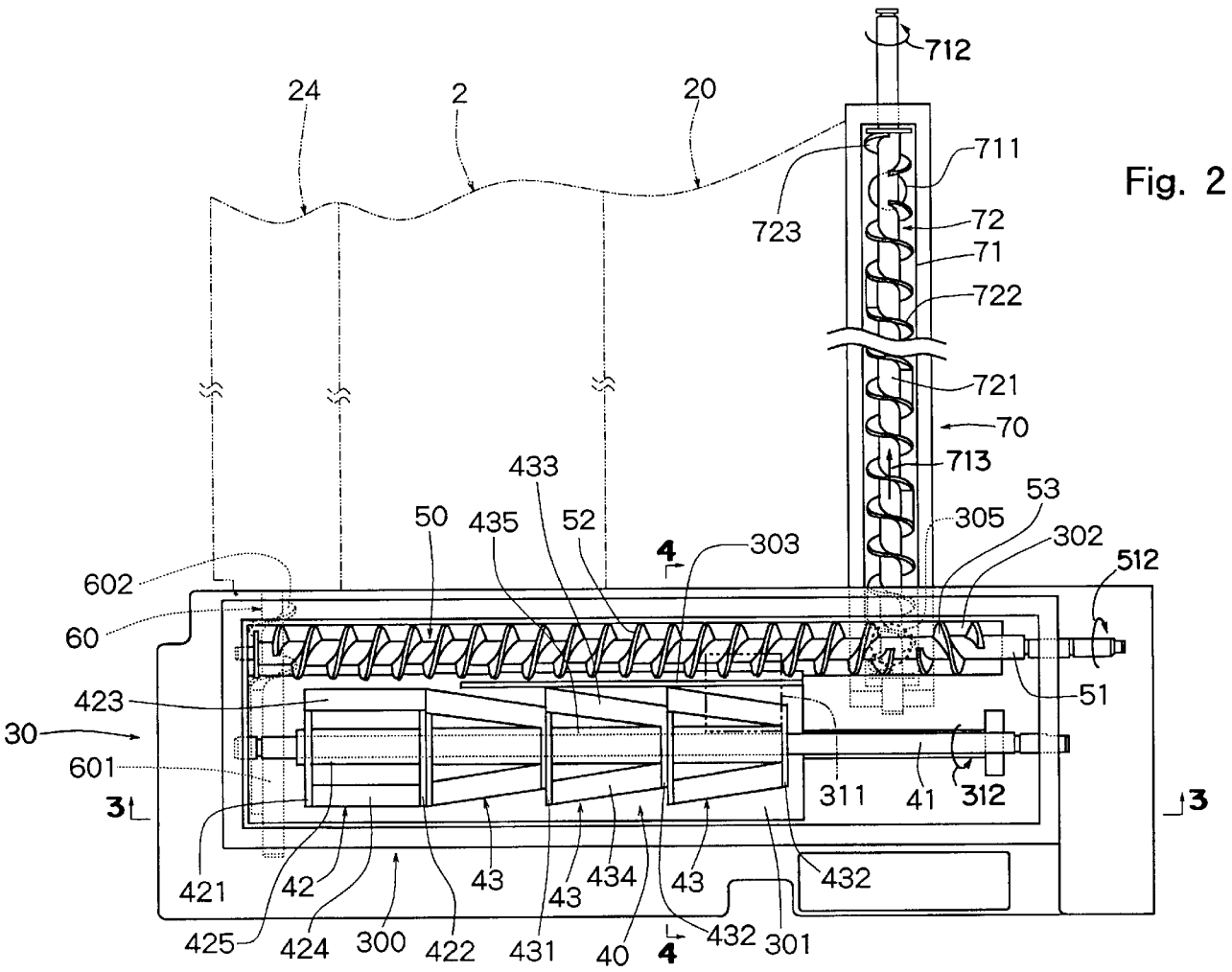
FIG. 2 is a bottom plan view of the toner replenishing device constructed in accordance with the invention.
Figure 3:
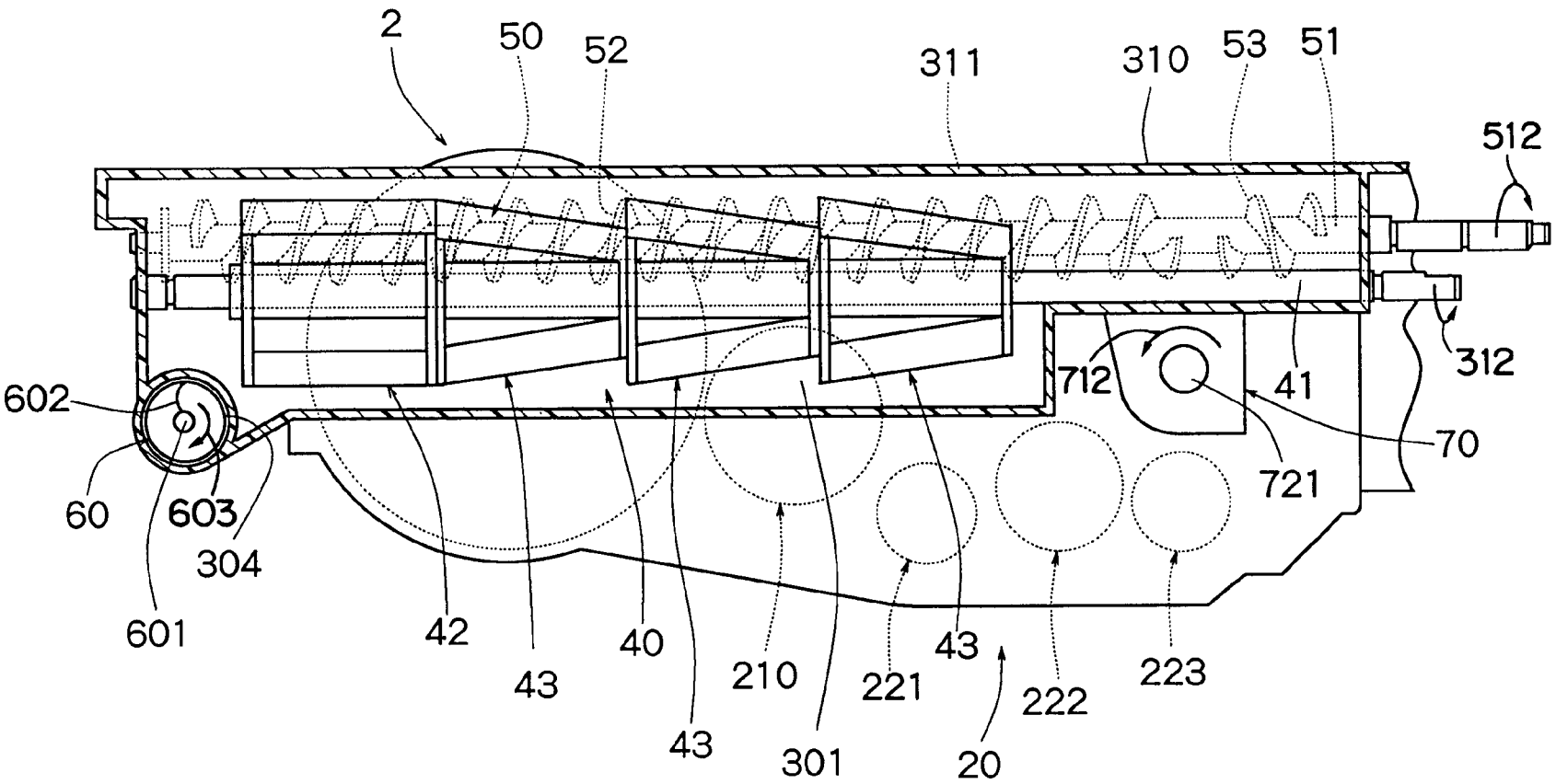
FIG. 3 is a sectional view taken on line 3—3 of the toner replenishing device shown in FIG. 2.
Figure 4:
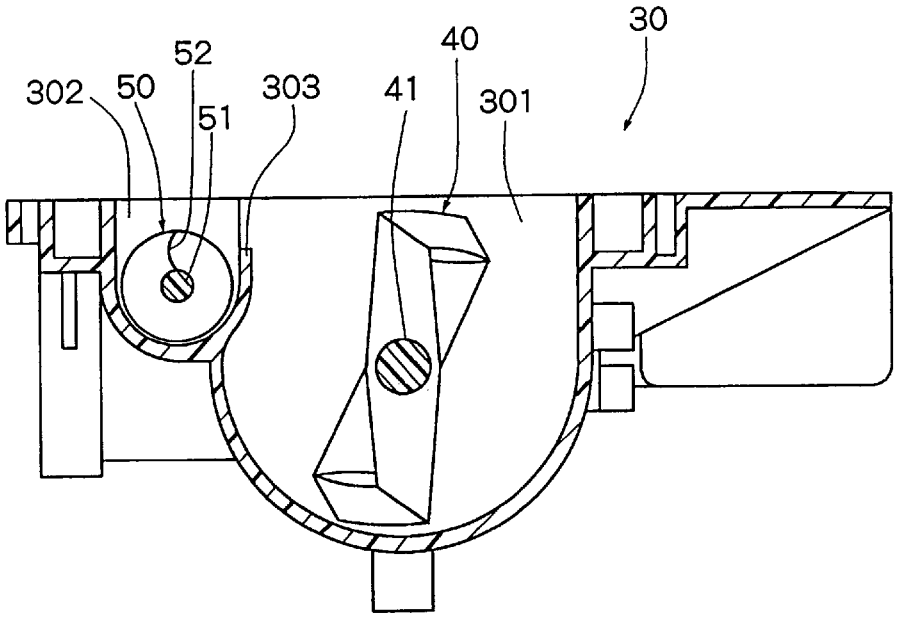
FIG. 4 is a sectional view taken on line 4—4 of the toner replenishing device shown in FIG. 2.

A toner replenishing device 30 is disposed forward of the photoconductor drum 2, the electrostatic latent image developing device 20, and the cleaning device 24 (shown in the lower portion of FIG. 2). The toner replenishing device 30 has a hopper housing 300. In the hopper housing 300, a toner agitating passageway 301 and a toner carrying passageway 302 are provided. The toner agitating passageway 301 is formed in a direction perpendicular to the axial direction of the rotating shaft of the photoconductor drum 2. The toner carrying passageway 302 is formed parallel to the toner agitating passageway 301 nearer to the photoconductor drum 2 than the toner agitating passageway 301 and with a greater length than the length of the toner agitating passageway 301. The toner carrying passageway 302 is formed at a higher position than the toner agitating passageway 301, as shown in FIG. 4. In the hopper housing 300, a partition plate 303 is provided between the toner agitating passageway 301 and the toner carrying passageway 302 with first end part of the toner agitating passageway 301 (the left end part in FIGS. 2 and 3) lacking the partition plate 303. In the side wall adjacent to the cleaning device 24 at the first end part of the hopper housing 300, a recovered toner inlet 304 is provided for having recovered toner sent in therethrough. The hopper housing 300 in the illustrated embodiment has a cover wall 310. In the cover wall 310, a fresh toner supply port 311 is formed which is provided opposite the toner agitating passageway 301 and the toner carrying passageway 302 and above the other or second end part of the toner agitating passageway 301. The fresh toner supply port 311 is detachably fitted with a toner cartridge (not shown).

In the toner agitating passageway 301 formed in the hopper housing 300, toner agitating means 40 is disposed for agitating fresh toner and the recovered toner that is introduced into the toner agitating passageway 301 and lifting them to the toner carrying passageway 302. The toner agitating means 40 is composed of a rotating shaft 41, and a first paddle 42 and a second paddle 43 that are mounted on the rotating shaft 41. The rotating shaft 41 is rotatably supported by the right and left end walls of the hopper housing 300, and is rotationally driven by a driving mechanism (not shown) in the direction of an arrow 312 shown in FIGS. 2 and 3. The first paddle 42 mounted on the rotating shaft 41 is composed of a single paddle, and disposed in the first end part of the toner agitating passageway 301 (the left end part in FIGS. 2 and 3). The second paddle 43 mounted on the rotating shaft 41 is composed of three paddles in the illustrated embodiment, and is disposed toward the other end part side, relative to the first paddle 42, in the toner agitating passageway 301.

Figure 5:
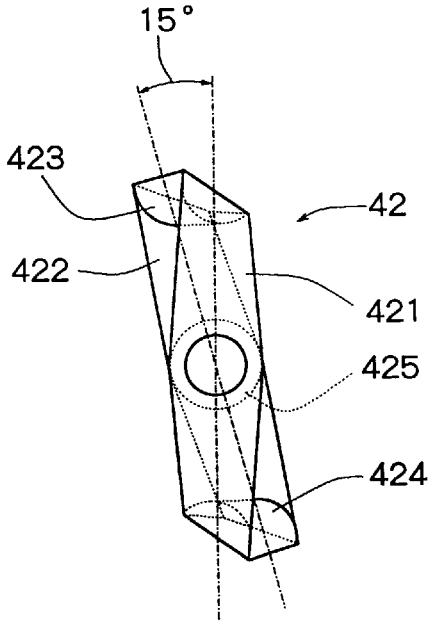
FIG. 5 is a side view of a first paddle constituting toner agitating means of the toner replenishing device shown in FIG. 2.

The first paddle 42 is constructed from two side plates 421 and 422 having holes in the center which are fitted over the rotating shaft 41, a boss portion 425 connecting the centers of the two side plates 421 and 422 together and having a hole fitted over the rotating shaft 41, and agitating/lifting blades 423 and 424 connecting the opposite ends of the two side plates 421 and 422 together. The first paddle 42 is integrally molded from suitable synthetic resin. The two side plates 421 and 422 in the illustrated embodiment are arranged with a phase angle of about 15 degrees therebetween as shown in FIG. 5. Thus, the agitating/lifting blades 423 and 424, which connect the opposite ends of the two side plates 421 and 422 together, are inclined with respect to the axis. This inclination is formed so as to send the toner from the first end part toward the other end part of the toner agitating passageway 301 (i.e., rightward in FIGS. 2 and 3) when the rotating shaft 41 is rotated in the direction of the arrow 312 shown in FIGS. 2 and 3.

Figure 6:
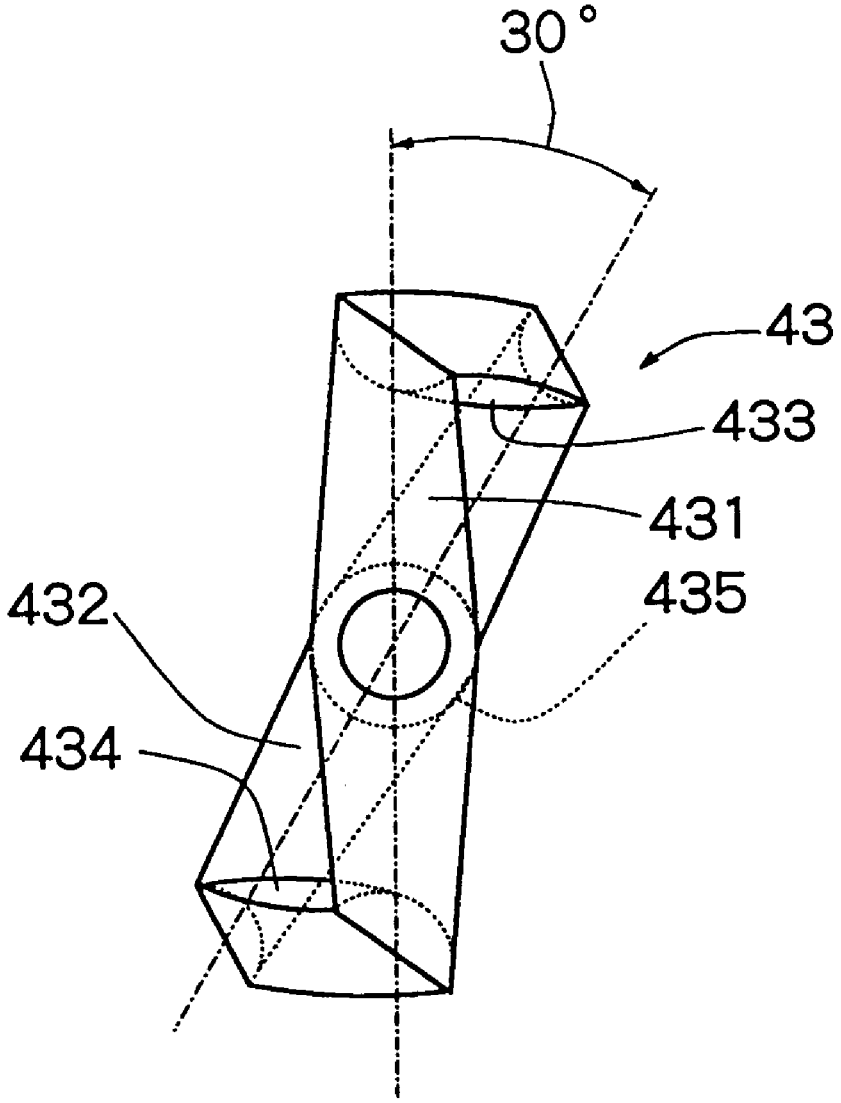
FIG. 6 is a side view of a second paddle constituting the toner agitating means of the toner replenishing device shown in FIG. 2.

The second paddle 43 is constructed from two side plates 431 and 432 having holes in the center which are fitted over the rotating shaft 41, a boss portion 435 connecting the centers of the two side plates 431 and 432 together and having a hole fitted over the rotating shaft 41, and agitating/lifting blades 433 and 434 connecting the opposite ends of the two side plates 431 and 432 together. The second paddle 43 is integrally molded from suitable synthetic resin. The two side plates 431 and 432 in the illustrated embodiment are arranged with a phase angle of about 30 degrees therebetween as shown in FIG. 6. Also, the side plates 431 and 432 are constituted with a phase in the direction opposite to the direction of the phase of the side plates 421 and 422 of the first paddle 42. Thus, the agitating/lifting blades 433 and 434, which connect the opposite ends of the two side plates 431 and 432 together, are inclined with respect to the axis in the direction opposite to the direction of inclination of the agitating/lifting blades 423 and 424 of the first paddle 42. This inclination is formed so as to send the toner from the other end part toward the first end part of the toner agitating passageway 301 (i.e., leftward in FIGS. 2 and 3) when the rotating shaft 41 is rotated in the direction of the arrow 312 shown in FIGS. 2 and 3. Furthermore, the inclination, with respect to the axis, of the agitating/lifting blades 433 and 434 constituting the second paddle 43 is greater than the inclination of the agitating/lifting blades 423 and 424 of the first paddle 42. This is because the toner carrying capacity of the second paddle 43 is made higher than the toner carrying capacity of the first paddle 42 so that the amount of the fresh toner carried by second paddle 43 is greater than the amount of recovered toner carried by the first paddle 42.

In the toner carrying passageway 302 formed in the hopper housing 300, toner carrying means 50 is disposed for carrying the toner agitated and lifted by the toner agitating means 40 to the toner carrying passageway 302. This toner carrying means 50 is composed of a rotating shaft 51, and a first spiral blade 52 and a second spiral blade 53 formed on the rotating shaft 51. The rotating shaft 51 is rotatably supported by the right and left end walls of the hopper housing 300, and is rotationally driven by a driving mechanism (not shown) in the direction indicated by an arrow 512 in FIGS. 2 and 3. The first spiral blade 52 has the winding direction of its spiral set so as to send the toner from the first end part toward the other end part of the toner carrying passageway 302 (i.e., from left to right in FIGS. 2 and 3) when the rotating shaft 51 is rotated in the direction of the arrow 512 shown in FIGS. 2 and 3. The second spiral blade 53 has the winding direction of its spiral opposite to the winding direction of the spiral of the first spiral blade 52. Thus, the second spiral blade 53 acts to push back the toner carried by the first spiral blade 52 from the first end part toward the other end part of the toner carrying passageway 302 when the rotating shaft 51 is rotated in the direction of the arrow 512 shown in FIGS. 2 and 3. In the toner carrying passageway 302 having the toner carrying means 50 disposed therein, a toner outlet 305 is provided at a position where the first spiral blade 52 and the second spiral blade 53 are opposed to each other.

In the hopper housing 300, recovered toner sending-in means 60 is disposed so as to be inserted into the recovered toner inlet 304. The recovered toner sending-in means 60 is composed of a rotating shaft 601 and a spiral blade 602 provided on the peripheral surface of the rotating shaft 601. The recovered toner sending-in means 60 is rotationally driven in the direction of an arrow 603 (FIG. 3) by a driving mechanism (not shown) to send the recovered toner carried by the recovered toner carrying means 243 of the cleaning device 24 into the first end part of the toner agitating passageway 301.

Below the toner outlet 305 provided in the toner carrying passageway 302, a toner supplying mechanism 70 is disposed. The toner supplying mechanism 70 includes a toner carrying passageway 71, ranging from below the toner outlet 305 to above the toner acceptance opening 203*a* formed in the upper wall 203 constituting the development housing 200 of the electrostatic latent image developing device 20, and toner carrying means 72, disposed in the toner carrying passageway 71. At an end part of the toner carrying passageway 71 beside the electrostatic latent image developing device 20, a toner fall port 711 is provided opposite the toner acceptance opening 203*a*. The toner carrying means 72 is composed of a rotating shaft 721, and a first spiral blade 722 and a second spiral blade 723 formed on the rotating shaft 721. The rotating shaft 721 is rotatably supported by the front and rear end walls constituting the toner carrying passageway 71, and is rotationally driven by a driving mechanism (not shown) in the direction indicated by an arrow 712 in FIGS. 2 and 3. The first spiral blade 722 has the winding direction of its spiral set so as to send the toner from the hopper housing 300 side of the toner carrying passageway 71 toward the toner fall port 711 (i.e., from below to above in FIG. 2) when the rotating shaft 721 is rotated in the direction of the arrow shown in FIGS. 2 and 3. The second spiral blade 723 has the winding direction of its spiral opposite to the winding direction of the spiral of the first spiral blade 722. Thus, the second spiral blade 723 acts to push back the toner carried by the first spiral blade 722 from the hopper housing 300 side of the toner carrying passageway 71 toward the toner fall port 711 when the rotating shaft 721 is rotated in the direction of the arrow 712 shown in FIGS. 2 and 3. Thus, the toner carried by the first spiral blade 722 is caused to fall reliably from the toner fall port 711 into the development housing 200 through the toner acceptance opening 203*a*.

The actions and effects of the toner replenishing device 30 constituted as above will be described.

As the toner of the developer in the development housing 200 is consumed by the aforementioned developing action, the detector 250 detects a decrease in the toner concentration of the developer. Based on its detection signal, the toner replenishing device 30 is actuated by control means (not shown). Upon the actuation of the toner replenishing device 30, fresh toner is supplied from a toner cartridge (not shown) into the toner agitating passageway 301 and the toner carrying passageway 302 through the fresh toner supply port 311 formed in the cover wall 310 of the hopper housing 300. The fresh toner supplied to the other end part of the toner agitating passageway 301 (the right end part in FIG. 2) is carried toward the first end part of the toner agitating passageway 301 while being agitated by the three second paddles 43 constituting the toner agitating means 40. That is, the agitating/lifting blades 433 and 434 constituting the second paddle 43 are formed so as to be inclined with respect to the axis as stated previously. Thus, when rotated in the direction of the arrow 312, the agitating/lifting blades 433 and 434 carry the fresh toner supplied to the other end part of the toner agitating passageway 301 toward the first end part thereof (the left end part in FIG. 2). Hence, the fresh toner supplied to the toner agitating passageway 301 is caused to flow toward the first end part without stagnating near the center of the second paddle 43.

On the other hand, the recovered toner that has been recovered by the cleaning device 24 and carried by the recovered toner carrying means 243 is sent into the first end part of the toner agitating passageway 301 by the recovered toner sending-in means 60. The recovered toner sent into the first end part of the toner agitating passageway 301 is carried toward the other end part of the toner agitating passageway 301 by the first paddles 42 of the toner agitating means 40. That is, the agitating/lifting blades 423 and 424 constituting the first paddle 42 are formed so as to be inclined with respect to the axis in the direction opposite to the direction of inclination of the agitating/lifting blades 433 and 434 of the second paddle 43, as stated previously. Thus, when rotated in the direction of the arrow 312, the agitating/lifting blades 423 and 424 carry the recovered toner sent into the first end part of the toner agitating passageway 301 toward the other end part thereof. Hence, the recovered toner supplied to the toner agitating passageway 301 is caused to flow without stagnating near the center of the first paddle 42.

The fresh toner carried toward the first end part of the toner agitating passageway 301 by the second paddle 43, and the recovered toner carried toward the other end part of the toner agitating passageway 301 by the first paddle 42 are agitated and mixed in the first end part of the toner agitating passageway 301 by the first paddle 42 and the second paddle 43 constituting the toner agitating means 40. The resulting toner mixture is lifted and fed into the first end part of the toner carrying passageway 302 through the site where no partition plate 303 is provided.

The toner mixture of fresh toner and recovered toner agitated and lifted to the toner carrying passageway 302 in the above manner is carried toward the other end part of the toner carrying passageway 302 by the toner carrying means 50. The fresh toner directly supplied from the toner cartridge to the toner carrying passageway 302 through the fresh toner supply port 311 is also carried toward the other end part of the toner carrying passageway 302 by the toner carrying means 50. Between the toner agitating passageway 301 and the toner carrying passageway 302, the partition plate 303 is provided. Thus, the toner mixture carried by the toner carrying means 50 does not drop from the toner carrying passageway 302 to the toner agitating passageway 301. This can prevent increase in the proportion of the recovered toner in toner agitating passageway 301 owing to falling of the toner mixture to the toner agitating passageway 301.

The toner mixture carried toward the other end part of the toner carrying passageway 302 by the toner carrying means 50 is caused to fall to the toner carrying passageway 71 of the toner supplying mechanism 70 through the toner outlet 305 provided in the toner carrying passageway 302. The toner mixture caused to fall to the toner carrying passageway 71 is carried by the toner carrying means 72 in the direction shown by an arrow 713, and is then fed into the development housing 200 through the toner fall port 711 and the toner acceptance opening 203*a*. This supply of the toner mixture into the development housing 200 increases the toner concentration of the developer in the development housing 200.

When the toner concentration of the developer in the development housing 200 reaches a predetermined value, the detector 250 detects this. Based on its detection signal, the operation of the toner replenishing device 30 is stopped by control means (not shown).

Since the toner replenishing device for an image forming machine according to the present invention is constituted as described above, it exhibits the following actions and effects:

In the toner replenishing device for an image forming machine according to the present invention, the toner agitating means disposed in the toner agitating passageway of the hopper housing has a first paddle disposed in a first end part of the toner agitating passageway, and a second paddle disposed on the other end part side of the toner agitating passageway and adjacent to the first paddle; and the first paddle has the function of sending toner to the other end part side of the toner agitating passageway, while the second paddle has the function of sending the toner to the first end part side of the toner agitating passageway. Thus, the fresh toner supplied to the other end part of the toner agitating passageway is caused to flow toward the first-end part side, while the recovered toner sent into the one end part of the toner agitating passageway is caused to flow toward the other end part side. The toner, therefore, does not stagnate near the center of the toner agitating means. Consequently, deterioration of toner owing to the stagnation of the fresh toner and the recovered toner in the toner agitating passageway can be avoided or delayed, so that the lowering of image quality due to the deterioration of toner can be prevented or delayed.

According to the present invention, moreover, a partition plate is disposed between the toner agitating passageway and the toner carrying passageway formed in the hopper housing, with the first end part of the toner agitating passageway lacking the partition plate. Thus, the toner mixture of fresh toner and recovered toner, which is carried by the toner carrying means disposed in the toner carrying passageway, does not drop from the toner carrying passageway to the toner agitating passageway. This can prevent an increase in the proportion of recovered toner in the toner agitating passageway owing to falling of the toner mixture to the toner agitating passageway.

What we claim is:

1. A toner replenishing device for an image forming machine, comprising:

a hopper housing having formed therein a toner agitating passageway, a toner carrying passageway parallel to the toner agitating passageway and at a position higher than the toner agitating passageway, a recovered toner inlet in a first end part of the toner agitating passageway for having recovered toner sent therethrough into the toner agitating passageway from a cleaning device of the image forming machine, and a fresh toner supply port above a second end part of the toner agitating passageway and opposite the toner agitating passageway for having fresh toner sent therethrough into the toner agitating passageway;

toner agitating means disposed in the toner agitating passageway for agitating the recovered toner and fresh toner supplied to the toner agitating passageway and lifting the recovered toner and fresh toner to the toner carrying passageway;

toner carrying means disposed in the toner carrying passageway for carrying the recovered toner and fresh toner lifted to the toner carrying passageway by the toner agitating means; and a toner supplying mechanism for conveying the recovered toner and fresh toner carried by the toner carrying means to a developing device of the image forming machine; wherein the toner agitating means comprises a first paddle disposed in the first end part of the toner agitating passageway, and a second paddle disposed in the second end part of the toner agitating passageway and adjacent to the first paddle, and the first paddle sends toner to the second end part of the toner agitating passageway, while the second paddle sends toner to the first end part of the toner agitating passageway.

2. The toner replenishing device for an image forming machine as claimed in claim 1, wherein the fresh toner supply port is formed opposite the toner agitating passageway and the toner carrying passageway.

3. The toner replenishing device for an image forming machine as claimed in claim 1, wherein the second paddle is composed of a plurality of paddle sections.

4. The toner replenishing device for an image forming machine as claimed in claim 1, wherein the second paddle has a toner carrying capacity greater than that of the first paddle.

5. A toner replenishing device for an image forming machine, comprising:

a hopper housing having formed therein a toner agitating passageway, a toner carrying passageway parallel to the toner agitating passageway and at a position higher than the toner agitating passageway, a recovered toner inlet in a first end part of the toner agitating passageway for having recovered toner sent therethrough into the toner agitating passageway from a cleaning device of the image forming machine, and a fresh toner supply port above a second end part of the toner agitating passageway and opposite the toner agitating passageway for having fresh toner sent therethrough into the toner agitating passageway;

toner agitating means disposed in the toner agitating passageway for agitating the recovered toner and fresh toner supplied to the toner agitating passageway and lifting the recovered toner and fresh toner to the toner carrying passageway;

toner carrying means disposed in the toner carrying passageway for carrying the recovered toner and fresh toner lifted to the toner carrying passageway by the toner agitating means; and a toner supplying mechanism for conveying the recovered toner and fresh toner carried by the toner carrying means to a developing device of the image forming machine; wherein a partition plate is disposed between the toner agitating passageway and the toner carrying passageway with the first end part of the toner agitating passageway lacking the partition plate.

6. The toner replenishing device for an image forming machine as claimed in claim 5, wherein the fresh toner supply port is formed opposite the toner agitating passageway and the toner carrying passageway.

* * * * *